US006119599A

United States Patent [19]

Johnson et al.

[11] Patent Number: 6,119,599

[45] Date of Patent: Sep. 19, 2000

[54] SEQUENTIAL ARC SURFACE INJECTOR

[75] Inventors: Richard Franklin Johnson, Crystal; Warren Joseph Dick, Little Canada; Reed Alan McPeak, St. Paul; Chris Sherman Sorenson, Edina; Leo Erasmus Thurmond, III, Coon Rapids, all of Minn.

[73] Assignee: United Defense, L.P., Arlington, Va.

[21] Appl. No.: 09/136,738

[22] Filed: Aug. 19, 1998

[51] Int. Cl.[7] ..... F42B 5/08

[52] U.S. Cl. ..... 102/472; 102/202; 102/430; 89/8

[58] Field of Search ..... 102/472, 202, 102/430; 89/8

[56] References Cited

U.S. PATENT DOCUMENTS

| | | | |
|---|---|---|---|
| 5,503,081 | 4/1996 | Lindblom et al. | 102/472 |
| 5,549,046 | 8/1997 | Widner et al. | 102/202.7 |
| 5,767,439 | 6/1998 | Lindblom et al. | 102/472 |

*Primary Examiner*—Michael J. Carone
*Assistant Examiner*—Daniel J. Beitey
*Attorney, Agent, or Firm*—Ronald C. Kamp

[57] ABSTRACT

The invention provides a device for generating surface plasmas, for ignition of propellants. The invention provides a plurality of sheet fuses with insulating sheets separating each fuse. One of the fuses is complete, while the other fuses have a gap. The fuses are sheets formed into concentric coaxial cylinders. The complete fuse forms the outer most cylinder. The fuses sequentially become a plasma starting from the outer most fuse to the inner most fuse.

13 Claims, 3 Drawing Sheets

SEQUENTIAL ARC SURFACE INJECTOR

BACKGROUND OF THE INVENTION

The present invention relates to a plasma generation device adapted to ignite an electrothermal-chemical propulsion system.

Plasma generation devices used to ignite an electrothermal-chemical propulsion system, may be used to ignite artillery shells in gun systems.

In an artillery shell or direct fire cartridge, a cylindrical plasma injector device may be used to create an equilibrated non-shorting distribution, infusion, and permeation of plasma through an explosive. In the prior art surface discharge plasma injectors, such as described in U.S. Pat. No. 5,503,081, incorporated by reference, are not able to continue to sustain current flow for a length of time that allows the most efficient ignition. Based on tests it appears that the rate of extinguishment is directly related to the rate at which current peak is reached, so that the faster current peak is reached, the faster the current shut off or "snuffing".

SUMMARY OF THE INVENTION

It is an object of the invention to provide plasma ignition device that can sustain current flow for a time that allows a prolonged ignition.

It is another object of the invention to provide a plasma ignition device that provides sequential arcs to allow a more efficient ignition.

The invention provides an arc surface plasma ignition device with parallel fuses that are ignited sequentially.

DESCRIPTION OF THE PREFERRED EMBODIMENTS

Figure 1:
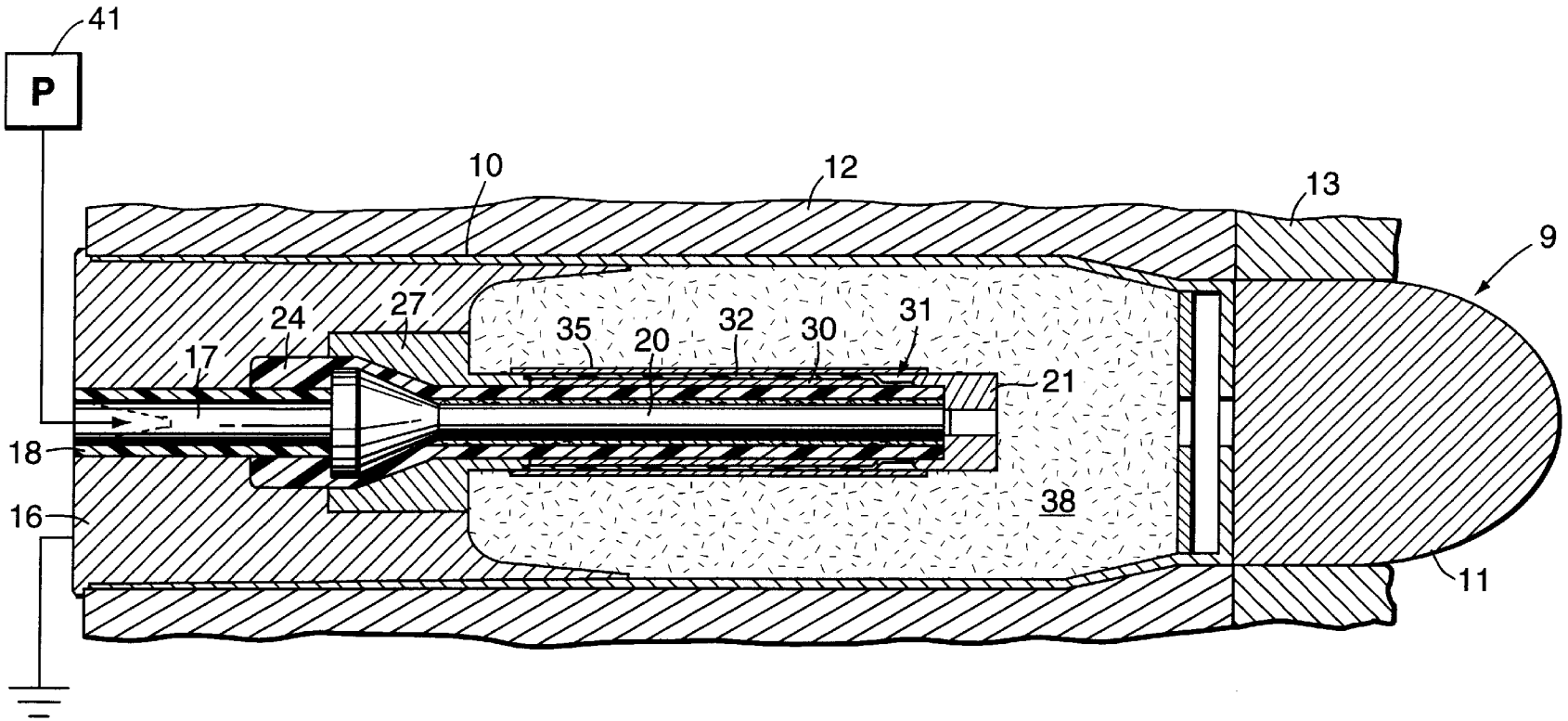
FIG. 1 is a cross-sectional view of an inventive surface plasma injector incorporated in a cartridge, which is attached to a projectile.

FIG. 1 is a cross-sectional view of an artillery shell 9, comprising a cartridge 10 integrally attached to a projectile 11, with the cartridge 10 mounted in a gun chamber 12 and the projectile 11 mounted in a gun tube 13. At a first end of the cartridge 10 is a stub case 16. A power contact 17 is placed at the center of the stub case 16. The power contact 17 is surrounded by a power contact insulator 18, to insulate the power contact 17 from the stub case 16. The power contact 17 is electrically connected to a first end of a power rod 20, which extends along the length of the central axis of the cartridge 10. At a second end of the power rod 20 is an ignition electrode 21, which is electrically connected to the power rod 20. A power rod insulator 24 surrounds the power rod 20, extending the length of the power rod 20 from the first end of the power rod 20 to the second end of the power rod 20. A return electrode 27 surrounds the power rod insulator 24 at the first end of the power rod 20.

A partial fuse 30 is formed by a sheet of conducting material, such as a aluminum foil formed into a tube surrounding the power rod insulator 24 and extending from the return electrode 27 along the length of the power rod 20 to the ignition electrode 21. A gap 31 is placed between the partial fuse 30 and the ignition electrode 21, extending completely around the circumference of the tube. The partial fuse 30 is surrounded by a partial fuse insulator 32, which extends from the return electrode 27 to the ignition electrode 21. The partial fuse insulator 32 is made from a sheet of insulating material, such as Kapton formed into a tube. A full fuse 35 is formed by a sheet of conducting material, such as aluminum foil, formed into a tube surrounding the partial fuse insulator 32 and extending from the return electrode 27 along the length of the power rod 20 to the ignition electrode 21. A combustible material 38, such as gun powder, fills the cartridge around the full fuse 35. The partial fuse 30 is nested with the partial fuse insulator 32 and the full fuse 35 in that the partial fuse 30 is surrounded by the partial fuse insulator 32 which is surrounded by the full fuse 35.

Figure 2:
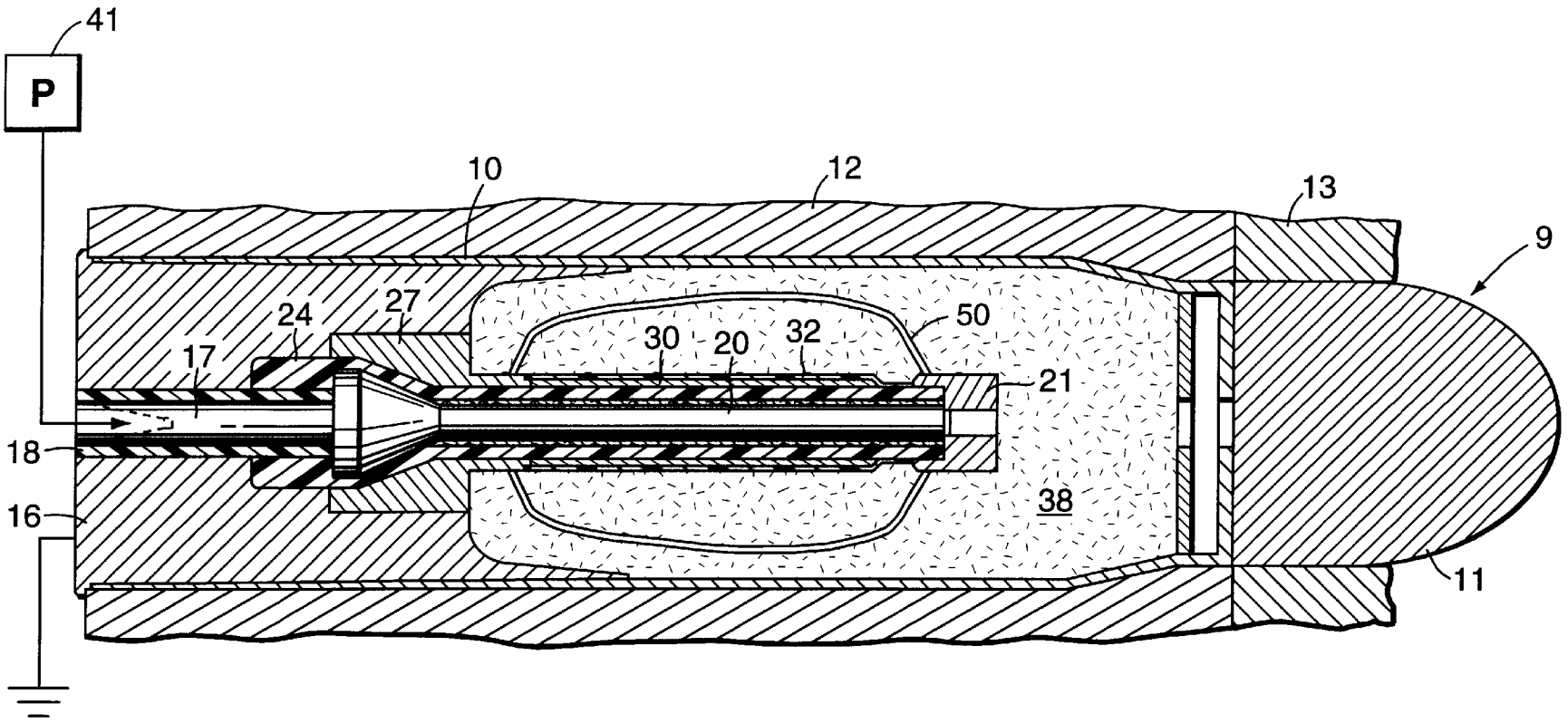
FIG. 2 is a cross-sectional view of the embodiment shown in FIG. 1, showing a plasma arc.

In operation, the artillery shell 9 is mounted in the gun chamber 12 and gun tube 13 as shown. A power supply 41 is electrically connected to the power contact 17, and the stub case 16 is grounded. A voltage is supplied by the power supply 41 to the power contact 17 creating a current which passes from the power contact 17 through the power rod 20 to the ignition electrode 21. From the ignition electrode 21 the current passes through the full fuse 35, and then through the return electrode 27 to the stub case 16, where it passes to ground. When the current path is sufficiently established, the full fuse 35 vaporizes allowing sufficient gas conductivity to establish a plasma between the ignition electrode 21 and the return electrode 27 surrounding the power rod 20. The plasma will have a temperature of 10,000 K to 20,000 K, which is hot enough to ignite the combustible material 38. As the plasma arc is developed, the plasma arc 50 will begin to balloon out from the power rod 20, as shown in FIG. 2, because of magnetic forces (currents of opposite directions repel each other). This ballooning leads to a longer more resistive plasma arc, which begins to act like an opening switch driving the voltage up to approximately twice the applied voltage. In addition, as the combustible material 38 begins to burn, additional collisions of the plasma arc with the atoms or molecules of the burning combustible material 38 also increases the plasma arc's resistance. These factors cause the extinguishment of the plasma arc 50 with an increase in the transient voltage between the ignition electrode 21 and the return electrode 27.

As the plasma arc 50 created from the full fuse 35 begins to extinguish and the transient voltage grows, the gap between the partial fuse 30 and ignition electrode 21 is bridged by an arc and current begins to flow from the ignition electrode 27 across the arc to the partial fuse 30 and then to the return electrode 27. When the current path through the partial fuse 30 is sufficiently established, the partial fuse 30 and the partial fuse insulator 32 vaporize allowing sufficient gas conductivity to establish a second plasma arc between the ignition electrode 21 and the return electrode 27 surrounding the power rod 20. The second plasma arc will have a temperature of 10,000 K to 20,000 K, which is hot enough to continue to ignite the combustible material 38. As the second plasma arc is developed, the second plasma arc will begin to balloon out from the power rod 20 and will eventually extinguish. By providing two fuses which are sequentially ignited, the combustible material 38 is exposed to a plasma arc for a longer period of time, providing a better ignition.

Figure 3:
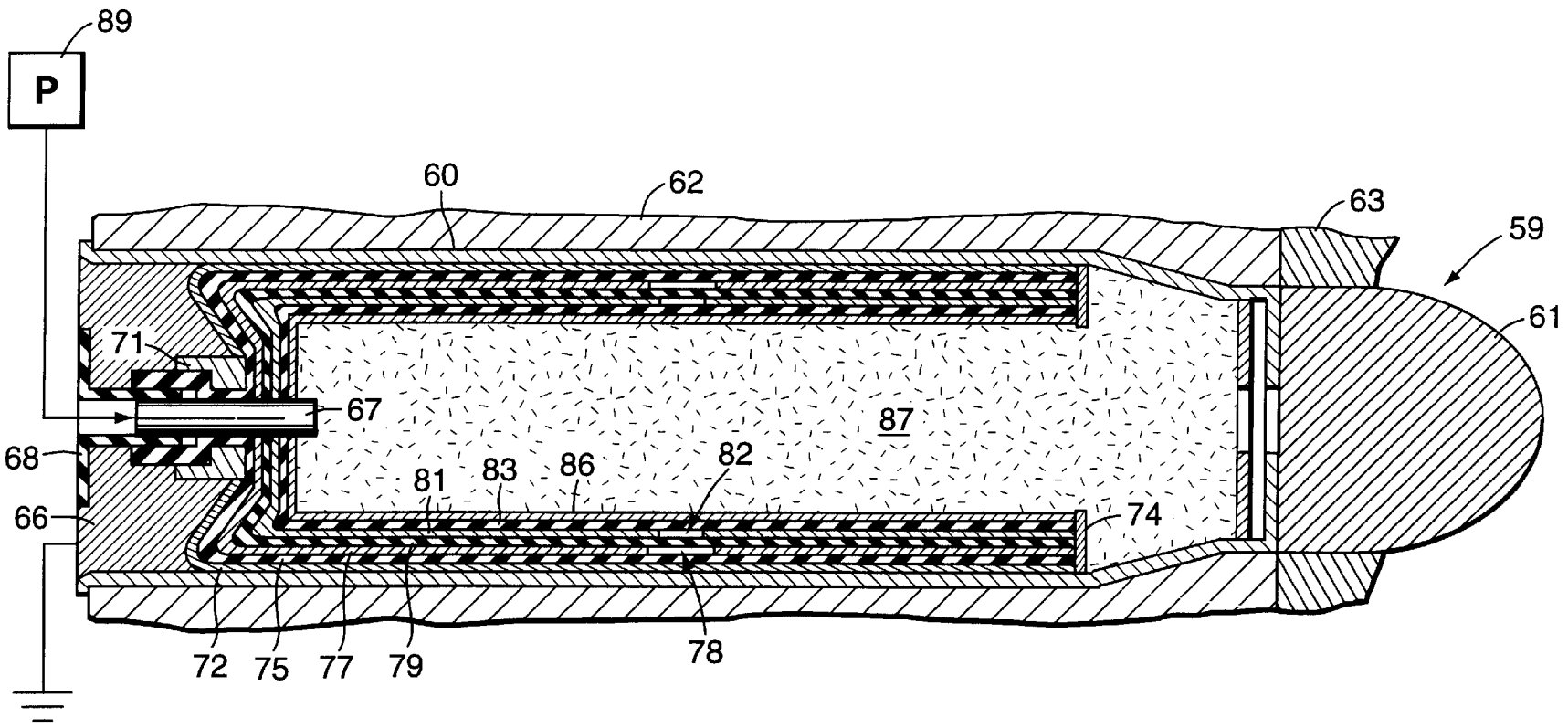
FIG. 3 is a cross-sectional view of another embodiment of the invention.

FIG. 3 is a cross-sectional view of an artillery shell 59, comprising a cartridge 60 integrally attached to a projectile 61, with the cartridge 60 mounted in a gun chamber 62 and the projectile 61 mounted in a gun tube 63. At a first end of the cartridge 60 is a stub case 66. A power contact 67 is placed at the center of the stub case 66. The power contact 67 is surrounded by a power contact insulator 68. A return electrode 71 surrounds the power contact insulator 68, and is electrically connected to the stub case 66. The power contact insulator 68 electrically insulates the power contact 67 from the stub case 66 and the return electrode 71. A return conductor 72 coats the inside of the stub case 66 and cartridge 60, extending from the return electrode 71 to an ignition electrode 74, where the return conductor 72 forms a cup shape with an aperture at the center of the bottom of the cup and where the ignition electrode 72 forms a ring on the inside of the cartridge 60. A return conductor insulator 75 is placed on the inner surface of the return conductor 72, forming a cup with an aperture at the center of the bottom of the cup and extending from the power contact insulator 68 to the ignition electrode 74.

A first partial fuse 77 is placed on the inner surface of the return conductor insulator 75, forming a cup with a tubular side and with an aperture at the center of the bottom of the cup, and extending from the power contact 67 to the ignition electrode 74. The first partial fuse 77 has a first partial fuse gap 78, which passes through the first partial fuse 77 and forms a ring around the circumference of the tubular side of the first partial fuse 77. A first partial fuse insulator 79 is placed on the inner surface of the first partial fuse 77, forming a cup with a tubular side and with an aperture at the center of the bottom of the cup, and extending from the power contact 67 to the ignition electrode 74 and filling the first partial fuse gap 78.

A second partial fuse 81 is placed on the inner surface of the first partial fuse insulator 79, forming a cup with a tubular side and with an aperture at the center of the bottom of the cup, and extending from the power contact 67 to the ignition electrode 74. The second partial fuse 81 has a second partial fuse gap 82, which passes through the second partial fuse 81 and forms a ring around the circumference of the tubular side. The second partial fuse gap 82 is narrower than the first partial fuse gap 78. A second partial fuse insulator 83 is placed on the inner surface of the second partial fuse 81, forming a cup with an aperture at the center of the bottom of the cup and extending from the power contact 67 to the ignition electrode 74 and filling the second partial fuse gap 82.

A full fuse 86 is placed on the inner surface of the second partial fuse insulator 81, forming a cup with a tubular side and with an aperture at the center of the bottom of the cup, and extending from the power contact 67 to the ignition electrode 74. A combustible material 87 is placed inside the cup shape of the full fuse 86 filling the remaining volume inside the cartridge 60.

The return conductor 72, first partial fuse 77, second partial fuse 81, and full fuse 86 are made of a thin electrically conducting material such as a thin metallic foil. The return conductor insulator 75, first partial fuse insulator 79, and second partial fuse insulator 83 are made of a thin electrically insulating material, such as Kapton.

The first partial fuse 77 is nested with the first partial fuse insulator 79 and the full fuse 86 in that the first partial fuse 77 surrounds the partial fuse insulator 79 which surrounds the full fuse 86. So nesting can either be that one object surrounds another or is surrounded by another. Although the full fuse 86 may not be formed from a flat sheet of foil, but possibly sprayed in place, the resulting planar surface forms a conductive sheet.

In operation, the artillery shell 59 is mounted in the gun chamber 62 and gun tube 63 as shown. A power supply 89 is electrically connected to the power contact 67, and the stub case 66 is grounded. A voltage is supplied by the power supply 89 to the power contact 67 creating a current which passes from the power contact 67 through the full fuse 86 to the ignition electrode 74. From the ignition electrode 74 the current passes through the return conductor 72, and then through the return electrode 71 to the stub case 66, where it passes to ground. When the current path is sufficiently established, the full fuse 86 vaporizes allowing sufficient gas conductivity to establish a plasma between the ignition electrode 71 and the power contact 67. The plasma will have a temperature of 10,000 K to 20,000 K, which is hot enough to ignite the combustible material 87. As the combustible material 38 begins to burn, additional collisions of the plasma arc with the atoms or molecules of the burning combustible material 87 increases the plasma arc's resistance. The plasma arc eventually extinguishes with an increase in the transient voltage between the ignition electrode 71 and the power contact 67.

As the plasma arc created from the full fuse 86 begins to extinguish and the transient voltage grows, the second partial fuse gap 82 is bridged by an arc and current begins to flow from the ignition electrode 74 through the second partial fuse 81 and then to the power contact 67. When the current path through the second partial fuse 81 is sufficiently established, the second partial fuse 81 and the second partial fuse insulator 83 vaporize allowing sufficient gas conductivity to establish a second plasma arc between the ignition electrode 74 and the power contact 67. The second plasma arc will have a temperature of 10,000 K to 20,000 K, which is hot enough to continue to ignite the combustible material 38. As the combustible material 38 burns, additional collisions of the plasma arc with the atoms or molecules of the burning combustible material 87 increases the plasma arc's resistance. The plasma arc eventually extinguishes with an increase in the transient voltage between the ignition electrode 71 and the power contact 67.

As the plasma arc created from the second partial fuse 81 begins to extinguish and the transient voltage grows, the first partial fuse gap 78 is bridged by an arc and current begins to flow from the ignition electrode 74 through the first partial fuse 77 and then to the power contact 67. When the current path through the first partial fuse 77 is sufficiently established, the first partial fuse 77 and the first partial fuse insulator 79 vaporize allowing sufficient gas conductivity to establish a third plasma arc between the ignition electrode 74 and the power contact 67. The third plasma arc will have a temperature of 10,000 K to 20,000 K, which is hot enough to continue to ignite the combustible material 38. As the combustible material 38 burns, additional collisions of the plasma arc with the atoms or molecules of the burning combustible material 87 increases the plasma arc's resistance. The plasma arc eventually extinguishes with an increase in the transient voltage between the ignition electrode 71 and the power contact 67.

Since the first partial fuse gap 78 is wider than the second partial fuse gap 82, the second partial fuse 81 ignites before the first partial fuse 77. The three sequentially ignited fuses extend the ignition time.

In other embodiments additional partial fuses and partial fuse insulators may be added to further extend the ignition time. The gap size would increase with each successive fuse in order of ignition. In other embodiments, the conductive sheets forming the fuses may be made of conductive porous membranes or webs that form a sheet. In other embodiments, the return electrode may be integrated into the stub case so that they form a single unit. In other embodiments, the igniter electrode and the power contact may be integrated into the power rod or the return conductor so that they form a single unit. In other embodiments, the gap is placed in other locations along the partial fuse, like adjacent to the return electrode, instead of being adjacent to the igniter electrode.

While preferred embodiments of the present invention have been shown and described herein, it will be appreciated that various changes and modifications may be made therein without departing from the spirit of the invention as defined by the scope of the appended claims.

What is claimed is:

1. A plasma arc device, mounted in a cartridge, comprising:

a first electrode;

a second electrode;

a full fuse formed by a conductive sheet extending between the first electrode and the second electrode a partial fuse formed by a conductive sheet extending substantially from the first electrode to the second electrode, wherein the partial fuse has a gap located between the first electrode and the second electrode; and a partial fuse insulator placed between the full fuse and the partial fuse.

2. The plasma arc device, as recited in claim 1, wherein the full fuse has a tubular shape, and the partial fuse has a tubular shape, and the partial fuse insulator has a tubular shape, and wherein the full fuse and the partial fuse and the partial fuse insulator are nested.

3. The plasma arc device, as recited in claim 2, wherein the gap extends around the circumference of the tubular shape of the first partial fuse.

4. The plasma arc device, as recited in claim 3, further comprising a combustible material adjacent to the full fuse.

5. The plasma arc device, as recited in claim 4, further comprising a projectile adjacent to the cartridge.

6. The plasma arc device, as recited in claim 5, further comprising:

a power rod of an electrically conductive material, electrically connected to the first electrode; and a power rod insulator of an electrically insulating material surrounding the power rod.

7. The plasma arc device, as recited in claim 6, wherein the partial fuse is adjacent to the power rod insulator, and wherein the partial fuse is in between the full fuse and the power rod insulator, and wherein the combustible material surrounds the full fuse.

8. The plasma arc device, as recited in claim 1, further comprising:

a power rod of an electrically conductive material, electrically connected to the first electrode; and a power rod insulator of an electrically insulating material surrounding the power rod.

9. The plasma arc device, as recited in claim 8, wherein the partial fuse is adjacent to the power rod insulator, and wherein the partial fuse is in between the full fuse and the power rod insulator, and wherein the combustible material surrounds the full fuse.

10. A method of creating an ignition, comprising the steps of:

applying a voltage to a first electrode;

injecting a current from the first electrode through a full fuse sheet to a second electrode;

creating a sheet plasma from the full fuse sheet;

extinguishing the sheet plasma from the full fuse sheet;

creating an arc across a gap in a partial fuse sheet;

producing a current from the first electrode through the partial fuse sheet through the arc across the gap in the partial fuse sheet to the second electrode;

creating a sheet plasma from the partial fuse sheet; and extinguishing the sheet plasma from the partial fuse sheet.

11. The method of creating an ignition, as recited in claim 10, further comprising the step of igniting a combustible material using the plasma from the full fuse sheet and from the partial fuse sheet.

12. The method of creating an ignition, as recited in claim 11, wherein the step of applying a voltage to the first electrode, applies the voltage through a power rod.

13. The method of creating an ignition, as recited in claim 12, wherein the steps of creating a sheet of plasma create the sheets of plasma surrounding the power rod.

* * * * *